US009289634B2

(12) United States Patent
Chabod et al.

(10) Patent No.: US 9,289,634 B2
(45) Date of Patent: Mar. 22, 2016

(54) SAFETY APPARATUS ON A ROPE WITH INDICATOR FOR INDICATING THE STATE OF CLOSING OF THE FLANGE-PLATES

(71) Applicant: ZEDEL, Crolles (FR)

(72) Inventors: Pierre Olivier Chabod, Pontcharra (FR); Christophe Quillard, Eybens (FR); Alain Maurice, Saint Hilaire du Touvet (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 14/155,970

(22) Filed: Jan. 15, 2014

(65) Prior Publication Data

US 2014/0196984 A1 Jul. 17, 2014

(30) Foreign Application Priority Data

Jan. 16, 2013 (FR) ..... 13 00093

(51) Int. Cl.

| | |
|---|---|
| ***A63B 29/02*** | (2006.01) |
| ***A62B 35/00*** | (2006.01) |
| ***A62B 1/14*** | (2006.01) |

(52) U.S. Cl.

CPC ..... *A62B 35/0081* (2013.01); *A62B 1/14* (2013.01); *A63B 29/02* (2013.01)

(58) Field of Classification Search

CPC ..... A62B 1/14; A62B 35/0081; A63B 29/02
See application file for complete search history.

(56) References Cited

U.S. PATENT DOCUMENTS

| | | | | | |
|---|---|---|---|---|---|
| 5,054,577 | A * | 10/1991 | Petzl et al. | 182/5 |
| 5,265,696 | A * | 11/1993 | Casebolt | 182/8 |
| 5,360,083 | A * | 11/1994 | Hede | 182/5 |
| 5,577,576 | A * | 11/1996 | Petzl et al. | 188/65.4 |
| 5,845,894 | A | 12/1998 | Petzl et al. | |
| 6,029,777 | A * | 2/2000 | Rogelja | 182/193 |
| 6,793,046 | B2 * | 9/2004 | Petzl et al. | 188/188 |
| 7,757,812 | B2 * | 7/2010 | Bamberg et al. | 182/5 |
| 7,845,467 | B2 * | 12/2010 | Petzl et al. | 182/5 |
| 8,100,231 | B2 * | 1/2012 | Petzl et al. | 188/65.5 |
| 8,348,016 | B2 * | 1/2013 | Lewis et al. | 182/192 |
| 2011/0186388 | A1 * | 8/2011 | Sudale et al. | 188/65.2 |
| 2012/0012800 | A1 | 1/2012 | Chaumontet | |
| 2012/0241700 | A1 | 9/2012 | Mauthner et al. | |

FOREIGN PATENT DOCUMENTS

| | | |
|---|---|---|
| AU | 700898 | 10/1997 |
| EP | 0 376 860 B1 | 2/1992 |
| EP | 0 803 268 A1 | 10/1997 |
| EP | 2 407 413 A1 | 1/2012 |

* cited by examiner

*Primary Examiner* — Colleen M Chavchavadze
(74) *Attorney, Agent, or Firm* — Oliff PLC

(57) ABSTRACT

A safety apparatus on a rope, including a first flange-plate, an operable second flange-plate, and a mechanical indicator collaborating when the swiveling movement takes place with both the first pivot-pin and a latch to indicate that the second flange-plate is in the closed and latched position, or in an unlatched ready-to-open state.

7 Claims, 11 Drawing Sheets

SAFETY APPARATUS ON A ROPE WITH INDICATOR FOR INDICATING THE STATE OF CLOSING OF THE FLANGE-PLATES

BACKGROUND OF THE INVENTION

The invention relates to a safety apparatus on a rope, comprising:

- a first flange-plate and a movable second flange-plate delineating a transverse space in which a roller is arranged fitted on a first pivot-pin integral to the first flange-plate,
- articulation means of the second flange-plate allowing a swiveling movement between a closed position clamping the rope in captive manner in the transverse space, and an open position for fitting the rope on the roller,
- and latching means of the second flange-plate in the closed position, said latching means comprising a pivoting latch controlled by control means.

STATE OF THE ART

A PRO TRAXION progress capture pulley marketed by the applicant is used in mountaineering or in working at heights for hoisting a load or a person along a rope. It comprises a pulley mounted rotating freely on a first pivot-pin of a fixed flange-plate, and a movable flange-plate articulated around a tubular second pivot-pin offset from the first pivot-pin. A fastening snap-hook passes through the hollow second pivot-pin and an aligned aperture of the first flange-plate in the closed position. The second flange-plate is thus able to be opened without being disconnected from the fastening. The rope can thus be fitted once the pulley has been fastened. A clamping pin or ratchet is designed to latch the second flange-plate in the closed position, but there is nothing to prevent the pin from being unlatched and the second flange-plate from being opened when the pulley is under load.

The documents EP 803268 and EP 2407413 refer to pulleys each having a swiveling openable flange-plate and an integrated clamp. The openable flange-plate remains latched in the closed position by the fastening snap-hook. It is impossible to open this flange-plate without removing the snap-hook and disconnecting from the fastening.

In safety equipment on a rope used in rock climbing, mountaineering or working at heights, it is known to check the state of closing or latching of a moving part.

For example the document EP 376860 indicates the latched or unlatched state of the blocking ring of the movable finger of a snap-hook. The indicator is arranged at the end of the movable finger and only indicates the state of latching, but not the state of closing of the finger. The ring can in fact be screwed tight to make the red indicator disappear, but the finger may not be closed, to the detriment of user safety.

The document AU700898 describes a descender and belaying apparatus having two offset rollers on the fixed first flange-plate and an additional roller on the openable second flange-plate. Actuating means are provided to choose operation of the apparatus in ascender mode with control of the speed of descent, or in belaying mode. Undesired opening of the second flange-plate requires locking of the latter on the first flange-plate by means of a gudgeon-pin or other fixing means passing through aligned holes of the two flange-plates.

Other apparatuses are provided with a flange-plate able to be opened by pivoting and an additional latching device. The two moving parts are distinct from one another. It is therefore necessary to control two actions at the same time. Known apparatuses make use of visual indicators which only detect a single action, either a closing or a latching action. Safety is not ensured in optimum manner.

OBJECT OF THE INVENTION

The object of the invention consists in providing a safety apparatus on a rope having an openable flange-plate, wherein it is desired to ensure correct closing of the flange-plate and engagement of the latching latch in normal operation.

The safety apparatus according to the invention is characterized in that the latch is associated with a mechanical indicator integral to the second flange-plate, said indicator collaborating both with the first pivot-pin of the roller and with the latch to indicate that the second flange-plate is in a latched closed state or in an unlatched ready-to-open state.

This results in the indicator remaining visible if the movable flange-plate is in the course of opening, and/or if the latch is actuated by the control means in the unlatching direction. A single indicator is then sufficient to indicate both the state of closing and of latching of the movable flange-plate.

According to a first embodiment, the indicator is formed by a coloured indicating lever articulated around a pivot-pin integral to the latch, said indicator being in a visible state through a hole of the front face if the latch is actuated in the unlatching direction or if the second flange-plate is not properly closed.

According to a second embodiment, the indicator is located on the pivoting latch, and an anti-return feeler element collaborates with said latch to keep the latter open, and the indicator visible, if the movable second flange-plate is not correctly closed on the first pivot-pin. The latch with its indicator constitutes a bistable lever in both the latched and unlatched positions.

The roller can be fixed or mounted rotating freely on the first pivot-pin. The roller can also be in the form of a free-wheel with unidirectional rotation and blocking in the opposite direction.

The invention applies to all types of safety apparatus on a rope with an openable flange-plate that has to be latched under load, in particular a descender, a pulley with or without an integrated clamp.

BRIEF DESCRIPTION OF THE DRAWINGS

Other advantages and features will become more clearly apparent from the following description of an embodiment of the invention given for non-restrictive example purposes only and represented in the appended drawings, in which.

DESCRIPTION OF TWO EMBODIMENTS OF THE INVENTION

Figure 1:
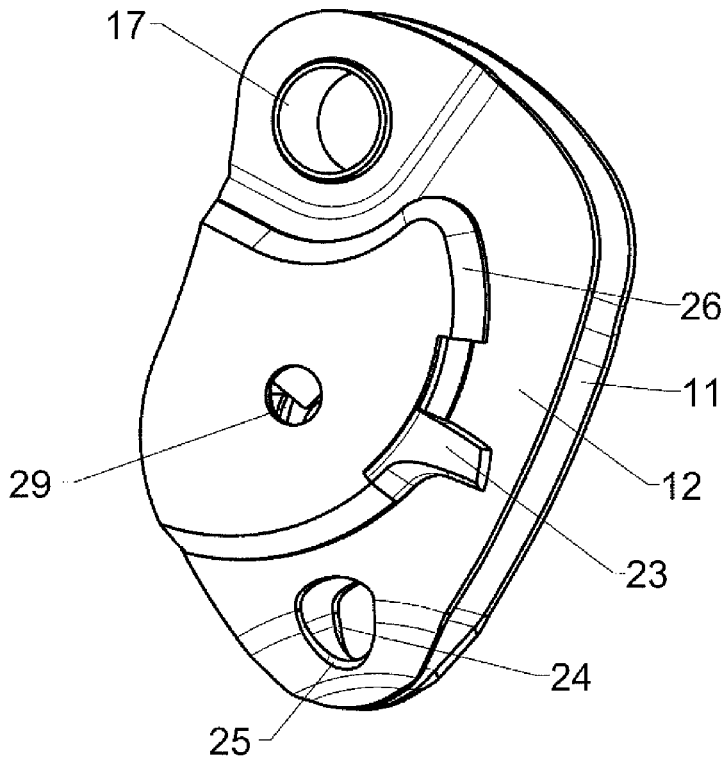
FIG. 1 is a view of the safety apparatus according to the invention, represented at the end of closing travel of the movable flange-plate, the indicator being invisible in the inactive position through a hole arranged in the front face.

With reference to FIGS. 1 to 6, a safety apparatus on a rope, designated by the general reference numeral 10, comprises a first flange-plate 11 and a movable second flange-plate 12 designed to occupy a closed position and an open position. First flange-plate 11 is provided with a first pivot-pin 13 on which a roller 14 is fitted provided with an annular throat 15 for guiding the rope. Roller 14 is fitted rotating freely on first pivot-pin 13 with a self-lubricating bearing 16 or a ball-bearing fitted between the two, the assembly constituting an openable pulley. The load is applied on roller 14 by means of the rope when second flange-plate 12 is in the closed position.

Roller 14 can also be fixed or be formed by a freewheel with unidirectional rotation and blocking in the opposite direction.

The invention also applies to any type of safety apparatus on a rope with an openable flange-plate, in particular a descender, a fall arrest clamp, etc. . . . .

The articulation means may correspond to, for example, a second pivot-pin 17, which is hollow for passage of an attachment snap-hook designed to be hooked onto an attachment point, and is fixed to the top part of movable second flange-plate 12. The hollow second pivot-pin 17 is housed with a clearance J in an opening 18 of first flange-plate 11, and can pivot when driving of second flange-plate 12 takes place to the open position. The diameter of hollow second pivot-pin 17 is smaller than that of opening 18 to define said translational clearance J of first flange-plate 11 in the heightwise direction. The transverse separating distance between the two flange-plates 11, 12 corresponds substantially to the length of second pivot-pin 17. The presence of clearance J makes first flange-plate 11 semi-fixed.

The inner surface of movable second flange-plate 12 is provided with a securing notch 19 in the form of a hook in which the end of first spindle 13 can engage when second flange-plate 12 moves to the closed position. This notch 19 is provided with a ramp 20 performing latching in the closed position when roller 14 or pulley is under load. A latch 21 pivoting on a spindle 22 is biased by a bias spring (not shown) to a blocking position to latch second flange-plate 12 positively in the closed position.

The front surface of second flange-plate 12 is equipped with control means 23 in the form of, for example, a pivoting handle, as can be seen in FIGS. 1-11. The control means 23 is integral to or coupled to latch 21 to perform releasing of the latter enabling opening of the pivoting second flange-plate 12 when the apparatus is no longer under load.

Each flange-plate 11, 12 comprises a hole 24, 25 in the bottom part, said holes being aligned in the closed position and enabling an additional snap-hook to be attached to padlock the device in the closed position.

Pivoting latch 21 is housed in an enclosure 26 and collaborates with a coloured indicator 27 which is constituted by a lever articulated around a pivot-pin 28 of latch 21.

Figure 2:
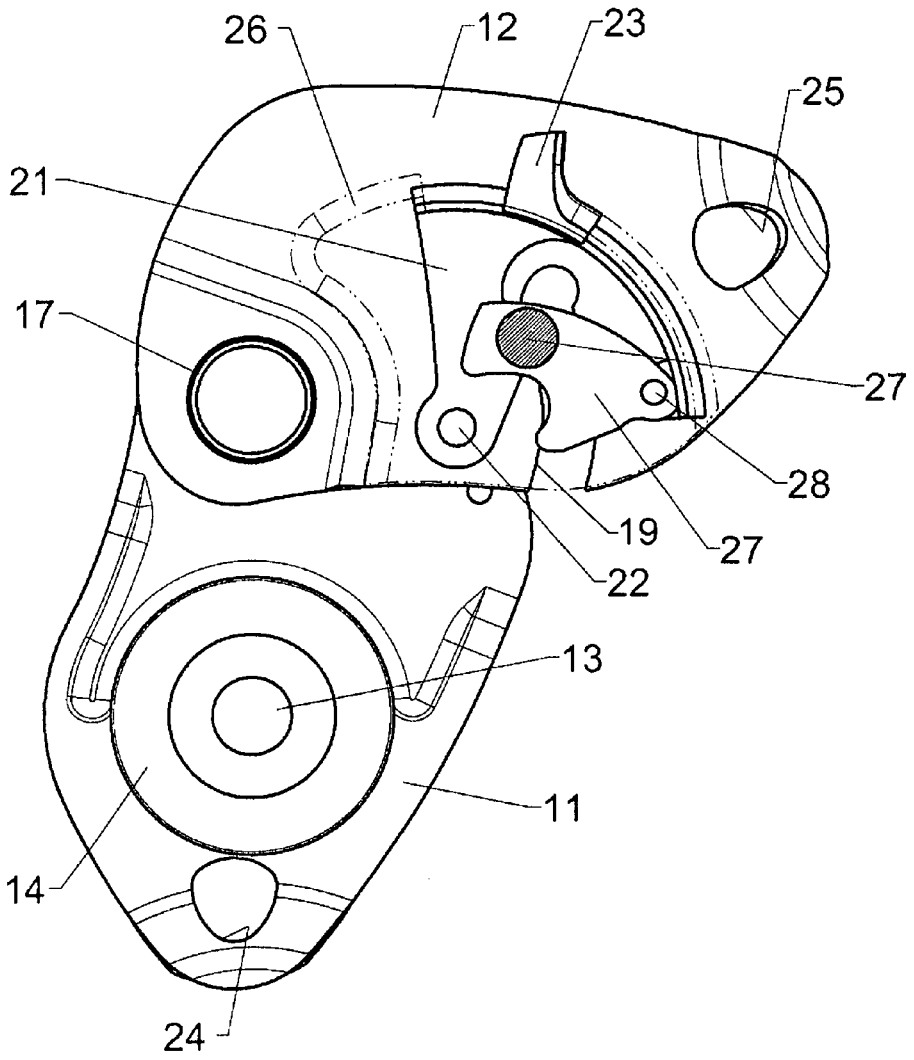
FIG. 2 shows the apparatus according to the invention, represented with the movable flange-plate in the open position for fitting of the rope, and showing the mechanism of the indicator.
Figure 3:
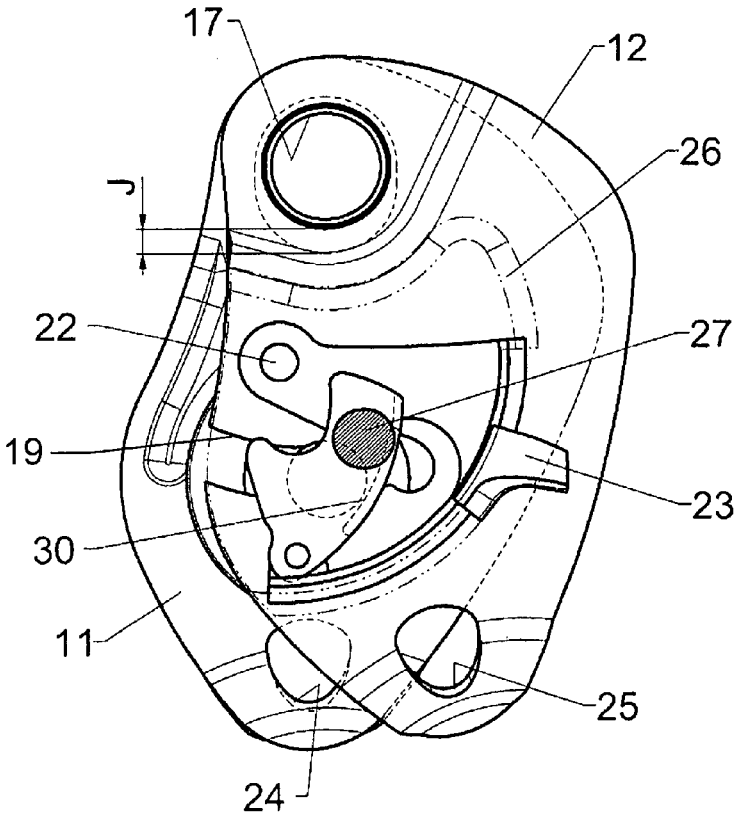
FIG. 3 shows the apparatus of FIG. 2 in the course of closing of the flange-plate and in the active position of the indicator.

Operation of safety device 10 with indicator according to the invention is as follows:

In FIG. 2, second flange-plate 12 is in the open position enabling the rope to be pivoted around the pulley. Indicator 27, for example of red colour, is visible from the front through a circular hole 29 arranged in enclosure 26. Indicator 27 remains visible independently from the position of control means 23.

In the course of closing of second flange-plate 12 (FIG. 3), the head of first pivot-pin 13 is engaged in notch 19 of movable second flange-plate 12, and comes into engagement with a rib 30 of indicator 27. The latter is linked to latch 21 by pivot-pin 28, but remains visible through hole 29 so long as second flange-plate 12 is not closed.

Figure 4:
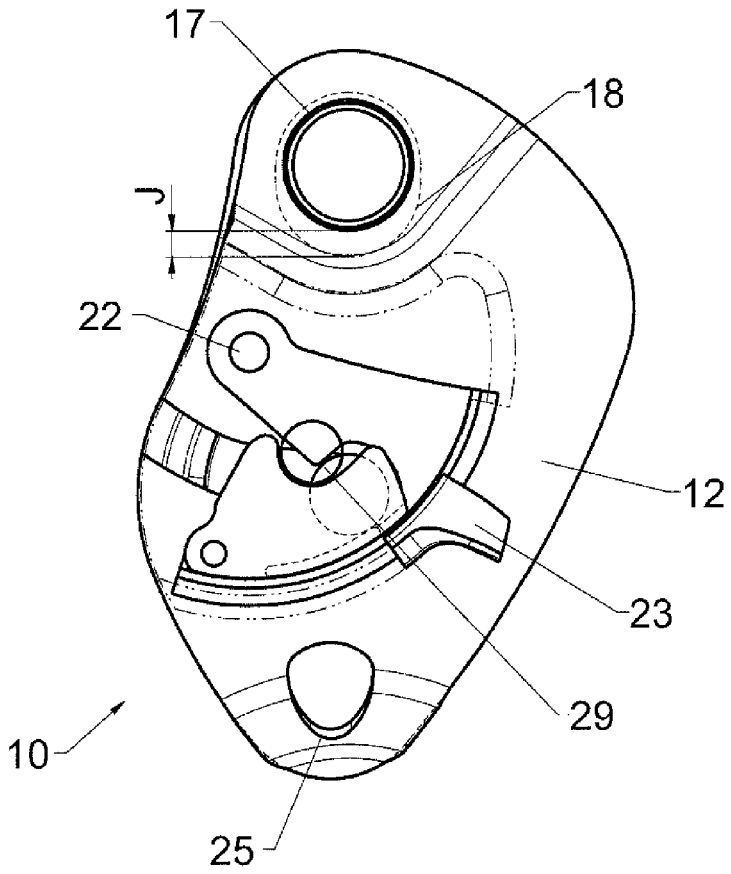
FIG. 4 shows the apparatus at the end of closing travel of the flange-plate, the indicator being invisible in the inactive position.

With reference to FIG. 4 representing the closed position, the head of first pivot-pin 13 is located at the bottom of notch 19, and presses on rib 30 forcing indicator 27 to remain in a non-visible state. Due to the effect of its bias spring, latch 21 latches the apparatus in the closed position.

Figure 5:
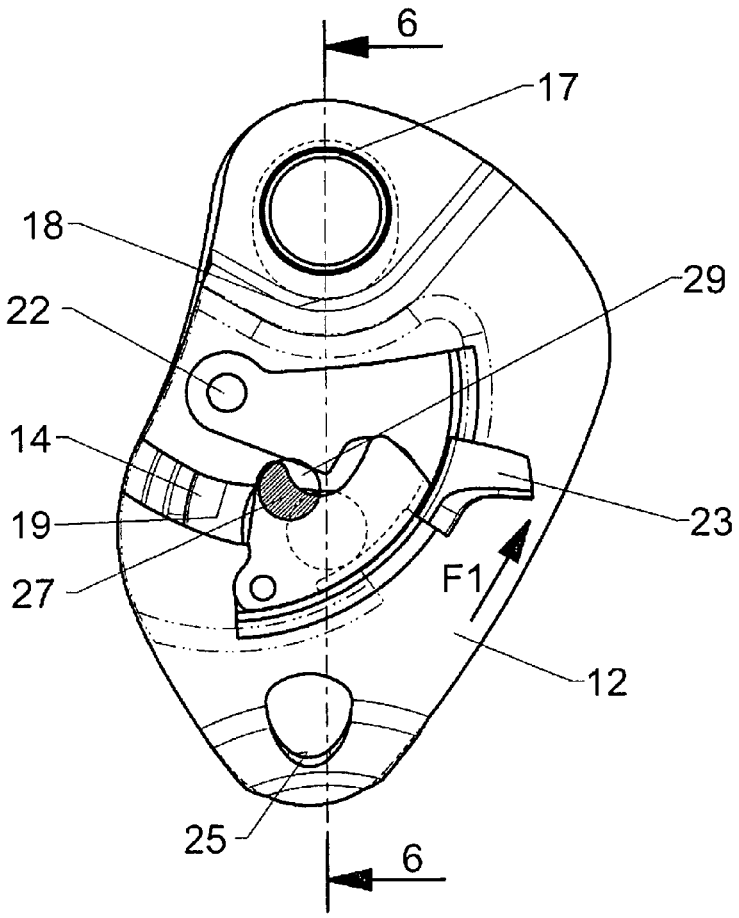
FIG. 5 shows the apparatus with the flange-plate closed, and the latch being actuated to the unlatched position making the indicator appear through a hole of the front face.
Figure 6:
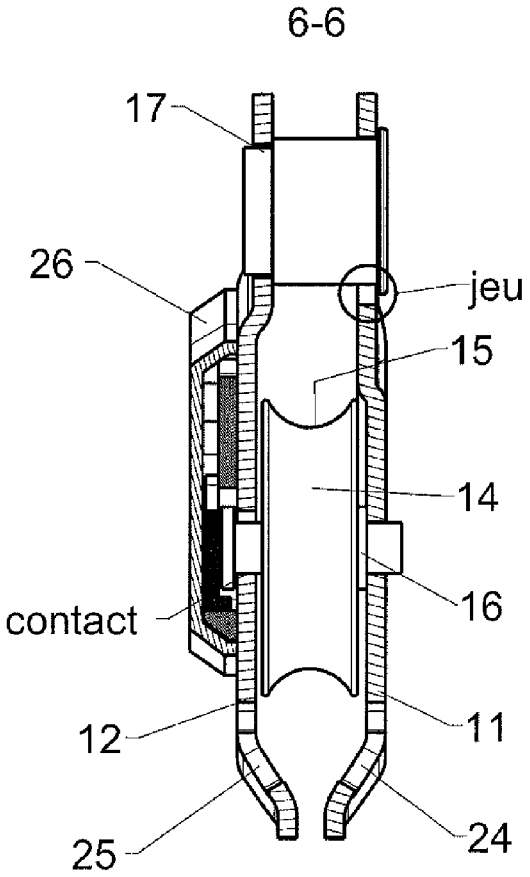
FIG. 6 is a cross-sectional view along the line 6-6 of FIG. 5.
Figure 7:
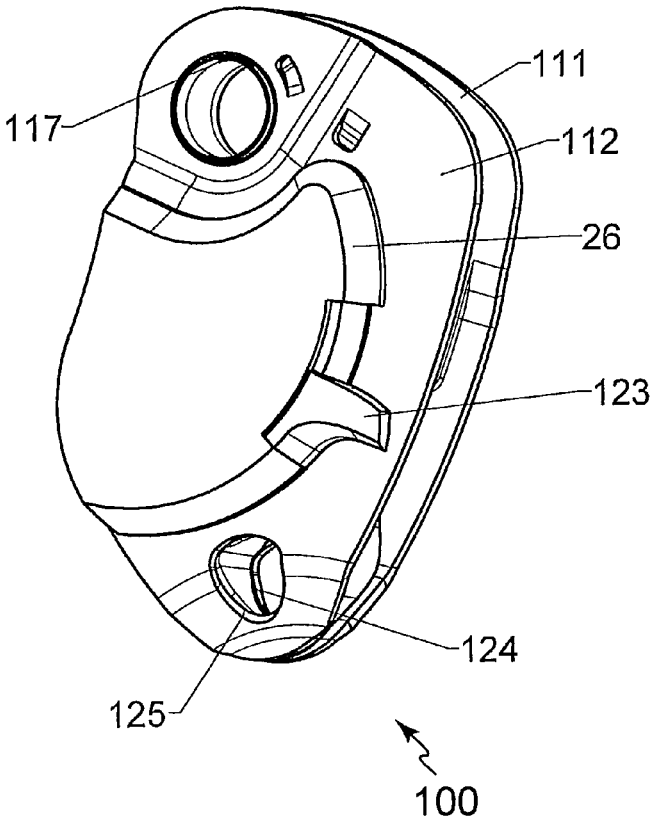
FIGS. 7 to 11 represent views of an alternative embodiment of the invention, respectively in the closed and open position of the movable flange-plate, in the course of closing, in the closed position, and when unlatching of the latch takes place.

In FIG. 5, second flange-plate 12 being closed, actuation of control means 23 in the direction of arrow F1 causes unlatching of latch 21 releasing the head of pivot-pin 13. Pivoting of latch 21 drives indicator 27 which again becomes visible, which announces that movement is taking place in the opening direction of the apparatus.

It can be noted that indicator 27 remains visible if movable flange-plate 12 is in the course of opening, and/or if latch 21 is actuated by control means 23 in the unlatching direction. A single indicator 27 is therefore sufficient to indicate both the closing and latching states of movable flange-plate 12. Indicator 27 becomes visible if latch 21 is unlatched, or if movable flange-plate 12 is incorrectly closed.

On the variant of FIGS. 7 to 11, apparatus 100 with openable flange-plate 112 can be equipped with an integrated blocker 40 of well-known type, known in particular from the document EP 803268. The parts that are identical to those of FIGS. 1 to 6 will no longer be described in detail in the following. They will bear the same reference numeral preceded by 100.

Indicator 127 is located directly on latch 121 underneath control means 123. It is visible from the side being associated with control means 123. An anti-return feeler element 41 collaborates with latch 121 to keep it open if movable flange-plate 112 is not correctly closed. Indicator 127 then remains visible in stable manner.

Figure 8:
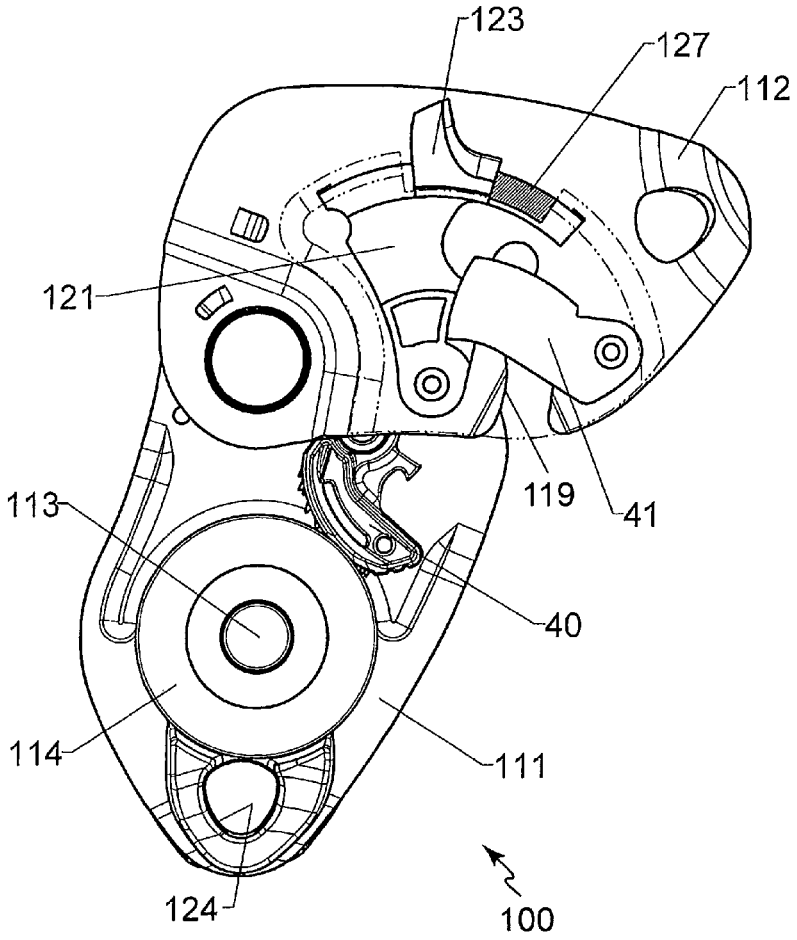
Figure 9:
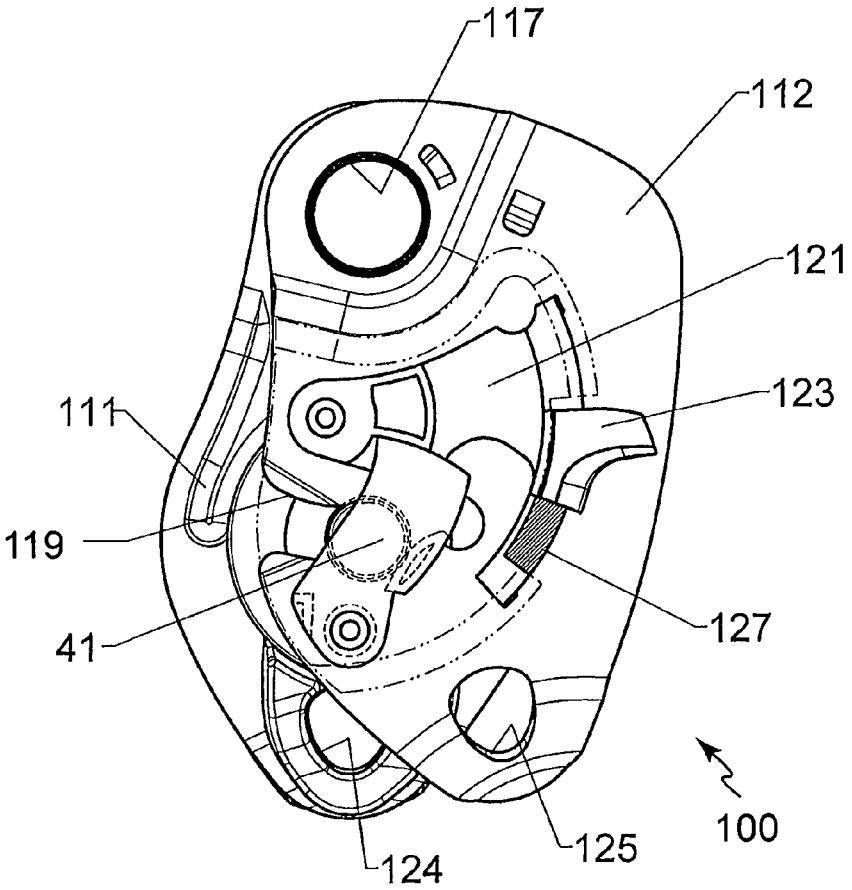

Operation of safety apparatus 100 is as follows:

In the open position of FIG. 8, indicator 127 is visible on latch 121, and control means 123 are kept in the raised position by feeler element 41. Clamp 40 simply has to be made to pivot in the counterclockwise direction to clear access to the pulley for fitting the rope in place.

In the course of closing a (FIG. 9), the head of first pivot-pin 113 enters into notch 119 of movable flange-plate 112, and comes into contact with anti-return feeler element 41. By continuing the swiveling movement of flange-plate 112, anti-return feeler element 41 is driven in rotation to a predefined angular position in which latch 121 and control means 123 move to the lowered position. Indicator 127 disappears progressively as control means 123 move downwards.

Figure 10:
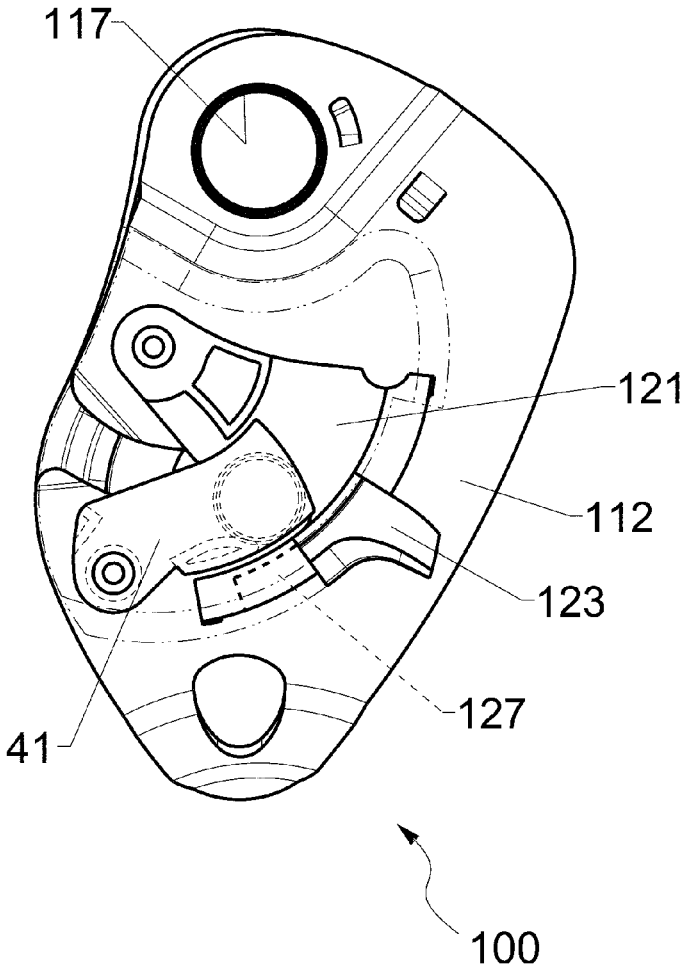

In FIG. 10 corresponding to the closed position of movable flange-plate 112, the head of first pivot-pin 113 is housed at the bottom of notch 119, and control means 123 are located in the lowered position. The head of first pivot-pin 113 forces anti-return feeler element 41 to remain in a neutral position where it cannot interfere with latch 121. Red indicator 127 remains invisible.

Figure 11:
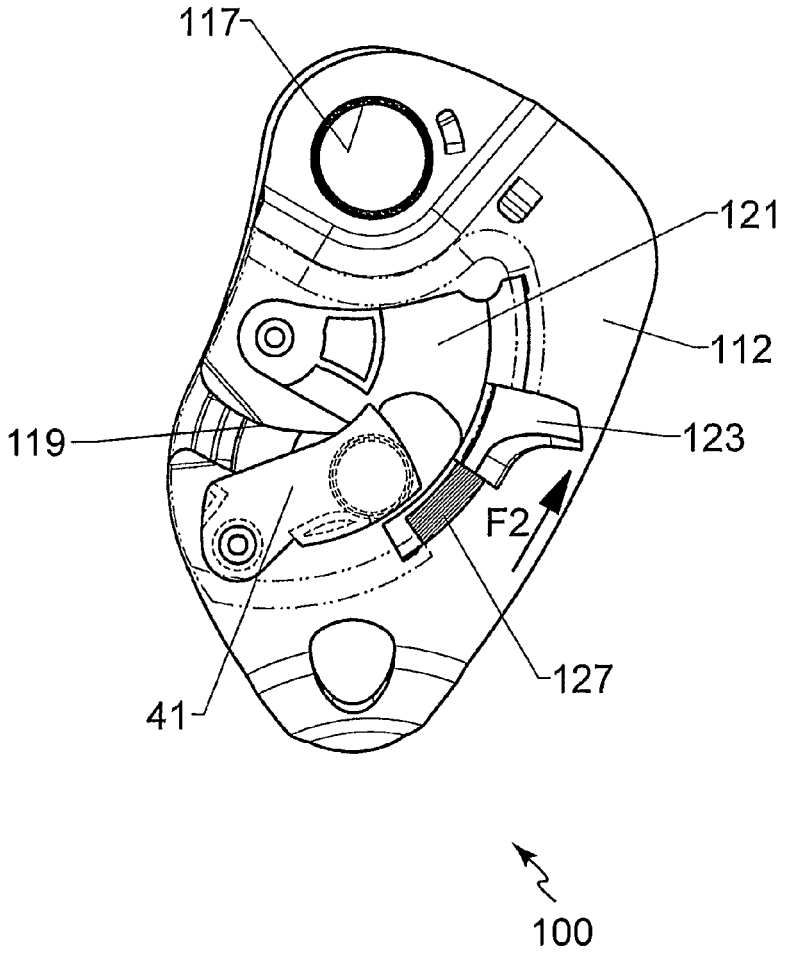

In FIG. 11, from the closed position, upward movement of control means 123 of latch 121 in the direction of arrow F2, drives indicator 127 which again becomes visible to indicate that apparatus 100 is going to be opened.

The concept of the invention can also be applied to an ascender or other belaying apparatus on a rope having an openable flange-plate, in which it is desired to detect correct closing of the flange-plate and engagement of the latch.

REFERENCES SIGNS LIST

10 Safety device
11, 111 First plate (first flange-plate)
12, 112 Second plate (second flange-plate)
13, 113 First pivot-pin
14, 114 Roller
15 Annular throat of roller
16 Self-lubricating bearing
17, 117 Second pivot-pin
18 Opening in first plate
19, 119 Securing notch
20 Ramp of securing notch
21, 121 Pivoting latch
22 Spindle
23, 123 Control means
24, 124 Hole
25, 125 Hole
26 Enclosure
27, 127 Mechanical indicator
28 Pivot-pin
29 Circular hole in enclosure
30 Rib
40 Integrated blocker
41 Anti-return feeler element

The invention claimed is:

1. A safety apparatus on a rope, the safety apparatus comprising:

a first plate, the first plate having a first pivot-pin that is integral to the first plate; and a movable second plate, the movable second plate delineating a transverse space in which a roller is arranged, the roller being fitted on the first pivot-pin, wherein when the second plate is in either an open position or a closed position, the second plate comprises:

articulation means that allow a swiveling movement between the closed position clamping the rope in captive manner in the transverse space, and the open position for fitting the rope on the roller;

latching means, the latching means including a pivoting latch and control means that control the pivoting latch;

a mechanical indicator located on the pivoting latch when the second plate is in either the open position or the closed position, the pivoting latch operating in conjunction with the mechanical indicator, and the mechanical indicator collaborating both with the first pivot-pin of the roller and with the pivoting latch to indicate that the second plate is in a latched closed state or in an unlatched ready-to-open state; and an anti-return feeler element that collaborates with the pivoting latch, both to keep the pivoting latch open and to keep the mechanical indicator visible if the movable second plate is not correctly closed on the first pivot-pin.

2. The safety apparatus according to claim 1, wherein when the second plate is in at least one of either a latched position or an unlatched position, the pivoting latch and the mechanical indicator comprise a bistable lever.

3. The safety apparatus according to claim 1, wherein the roller is in the form of a rotary pulley mounted idle on the first pivot-pin.

4. The safety apparatus according to claim 3, wherein the roller is associated with a blocking trigger designed to block the rope against the roller.

5. The safety apparatus according to claim 1, wherein the second plate includes a hollow second pivot-pin housed in an opening of the first plate, the second pivot-pin comprising the articulation means, the external diameter of the hollow second pivot-pin being smaller than that of the opening to define a translational clearance of the first plate in the heightwise direction.

6. The safety apparatus according to claim 1, wherein the second plate includes a securing notch in which a head of the first pivot-pin engages following movement of the second plate to the closed position.

7. The safety apparatus according to claim 1, wherein the mechanical indicator is colored.

* * * * *